United States Patent [19]

van der Werf et al.

[11] Patent Number: 4,507,180

[45] Date of Patent: Mar. 26, 1985

[54] METHOD OF ELECTRODEPOSITING A HOMOGENEOUSLY THICK METAL LAYER, METAL LAYER THUS OBTAINED AND THE USE OF THE METAL LAYER THUS OBTAINED, DEVICE FOR CARRYING OUT THE METHOD AND RESULTING MATRIX

[75] Inventors: Bernardus T. van der Werf; Gustaaf H. A. van der Hoorn, both of Eindhoven, Netherlands

[73] Assignee: U.S. Philips Corporation, New York, N.Y.

[21] Appl. No.: 587,791

[22] Filed: Mar. 9, 1984

[30] Foreign Application Priority Data

Mar. 14, 1983 [NL] Netherlands ..... 8300916

[51] Int. Cl.[3] ..... C25D 1/10; C25D 17/00

[52] U.S. Cl. ..... 204/5; 204/212; 204/275; 204/DIG. 7

[58] Field of Search ..... 204/5, 15, DIG. 7, 212, 204/216, 218, 273, 275

[56] References Cited

U.S. PATENT DOCUMENTS

| | | | |
|---|---|---|---|
| 4,259,166 | 3/1981 | Whitehurst | 204/DIG. 7 |
| 4,336,112 | 6/1982 | Van Hoek | 204/5 |
| 4,359,375 | 11/1982 | Smith | 204/212 |
| 4,391,694 | 7/1983 | Runsten | 204/5 |
| 4,415,423 | 11/1983 | Brooks | 204/5 |

*Primary Examiner*—Thomas Tufariello

*Attorney, Agent, or Firm*—Norman N. Spain

[57] ABSTRACT

The invention relates to a method for the electrodeposition of a homogeneously thick metal layer on the surface of a substantially flat cathode in which a screening member is placed in the electrolyte bath between the planes of the anode and the cathode. In order to improve the homogeneity of the thickness of the metal layer, which is desired, for example, in the manufacture of information carriers, a cylindrical screening member is used which is placed at a short distance from the cathode.

12 Claims, 4 Drawing Figures

METHOD OF ELECTRODEPOSITING A HOMOGENEOUSLY THICK METAL LAYER, METAL LAYER THUS OBTAINED AND THE USE OF THE METAL LAYER THUS OBTAINED, DEVICE FOR CARRYING OUT THE METHOD AND RESULTING MATRIX

The invention relates to a method of electrodepositing a homogeneously thick metal layer on the surface of a substantially flat substrate in which an anode and the substrate as cathode are placed opposite to each other in an electrolyte bath and a screening member is present between the planes of the anode and the cathode.

A substantially flat substrate is to be understood to mean herein a substrate having a surface the profile and unevenness of which are small as compared with the dimension of the surface.

The object of the screening member between the anode and the cathode is to promote the homogeneity of the thickness of the metal layer to be obtained.

Without a screening member the variation of the electric field lines in the electrolyte bath near the circumference of the cathode and the anode is such that a concentration of the field lines at the circumference of the cathode occurs as a result of which the layer to be formed at the circumference of the cathode is thicker than in the centre of the cathode.

It is endeavoured by means of a screening member to distribute the field lines more homogeneously over the cathode surface and to thus obtain a homogeneously thick metal layer.

Such a known screening member (see, for example, European patent application No. 58649) consists of an apertured flat plate which is accommodated in the electrolyte bath between and parallel to the cathode and the anode. The plate is accommodated near the anode. Usual plates consist of electrically insulating material and have at least one aperture of such a shape that a metal layer is deposited which as regards thickness is as homogeneous as possible.

It has been found in practice, however, that the desired tolerances of the thickness of the metal layer nevertheless are often not obtained.

One of the objects of the method according to the invention is to improve said situation on the basis of the recognition that the shape of the screening member can still be improved considerably. The method mentioned in the opening paragraph is therefore characterized according to the invention in that as a screening member there is used an electrically insulating material which has the shape of a cylinder the axis of which is perpendicular to the cathode and is further provided so that a slot-shaped aperture remains between the cathode and the screening member, the dimension of the slot-shaped aperture being small as compared with the size of the aperture of the screening member.

It has been found that when such a screening member is used a homogeneously thick metal layer can be obtained which satisfies stringent tolerance requirements.

When a slot-shaped aperture is used which is small as compared with the aperture of the screening member, the homogeneity of thickness of the deposited metal layer is very little dependent on the used current density and the temperature and the composition of the electrolyte bath.

A screening member is preferably used which encloses the cathode while leaving the slot-shaped aperture exposed. As a result of this a surface of a substrate can be covered entirely.

Alternatively, however, a screening member may be used the area of the aperture of which is smaller than the area of the cathode. Preferably the procedure is such that the cathode screens the aperture of the screening member while leaving the slot-shaped aperture exposed.

Optimum results as regards homogeneity of the deposited layer are obtained when a cathode is used in the form of a circular disk which is rotated in the electrolyte bath about the central axis perpendicularly to the surface of the disk on which the deposition occurs. A screening member is preferably chosen which is perpendicular to the anode and encloses the anode entirely.

As a result of this a number of measures become possible which enable a very good operation of the electrolyte bath.

For example, a screening member is preferably used whose cylinder surface comprises an inlet for the flow of the electrolyte to the slot-shaped aperture between the cathode and the screening member as a outlet.

By use of this member a good flow of the electrolyte at the cathode surface can be achieved.

It is evident that also the liquid-stream in the electrolysis compartment must be homogeneous, i.e. homogeneously turbulent or homogeneously laminar, in order to obtain a homogeneous layer thickness of the deposit. Sideways injection of the electrolyte-liquid for example, has turned out to be very favourable.

An anode is preferably used which consists of a hollow space in which metal is present which is to be deposited on the cathode. Said space comprises an aperture through which the electrolyte introduced through the inlet in the screening member is drained. As a result of this it is prevented that the electrolyte bath is contaminated by deposits which are formed at the area of the anode. The space furthermore comprises an aperture at the area of an aperture in the screening member when the screening member surrounds the anode and through which last-mentioned apertures the metal in the space is replenished. As a result of this, a continuous operation of the electrolyte bath is possible in a simple manner.

In principle the dimension of the slot-shaped aperture between the screening member and the cathode is as small as possible but for practical reasons is of the order of magniture of millimeters and is, for example, 5 millimeters.

The metal layer deposited by means of the method in accordance with the invention may be used in combination with the cathode (substrate) used. In such a case a good bonding between the layer and the substrate is desired.

It is also possible to use the metal layer from the cathode because easily handled layers of a sufficient thickness can be obtained by means of the method according to the invention.

The metal layer may be deposited on a cathode which is profiled with details having a thickness, for example, of a few 0.1 $\mu$m. If the thickness of the metal layer is a few 100 $\mu$m, the said details will no longer occur in the ultimate surface of the metal layer and the thickness of the metal layer as regards profile will satisfy tolerances of less than 1%, which is very good for many practical purposes. So in such a case the thickness of the profile of the cathode is preferably a few orders of magnitude smaller than the thickness of the metal layer to be electrodeposited.

Metal layers separated from the cathode are obtained, for example, by using a glass plate which has a layer of photolacquer of a 0.1 μm thickness in which a pattern is provided photomechanically and on which a layer of metal, for example silver, is vapour-deposited. And a 100 μm thick nickel layer may be deposited on the silver layer by means of the method according to the invention, which nickel layer with the silver layer can be separated from the glass plate and the layer of photolacquer.

The metal layer separated from the substrate (cathode) is preferably used in the manufacture of information carriers, either in a matrix for moulding disks for such information carriers, or in subsequent electrodeposition processes for the manufacture of a family of such metal layers.

The invention also relates to a matrix for the manufacture of information carriers which comprises a metal layer having a thickness tolerance which is less than 1%.

The invention also relates to a device for the electrodeposition of a homogeneously thick metal layer on the surface of a substantially flat substrate in which an anode and the substrate as cathode are placed opposite to each other in an electrolyte space and a screening member is present between the anode and the cathode.

According to the invention the screening member consists at least at the surface of electrically insulating material and has the shape of a cylinder whose axis is perpendicular to the cathode and which is provided so that a slot-shaped aperture remains exposed between the cathode and the screening member, the dimension of the slot-shaped aperture being small as compared with the size of the aperture of the screening member.

The invention will now be described in greater detail with reference to the accompanying drawing and an embodiment.

Figure 1:
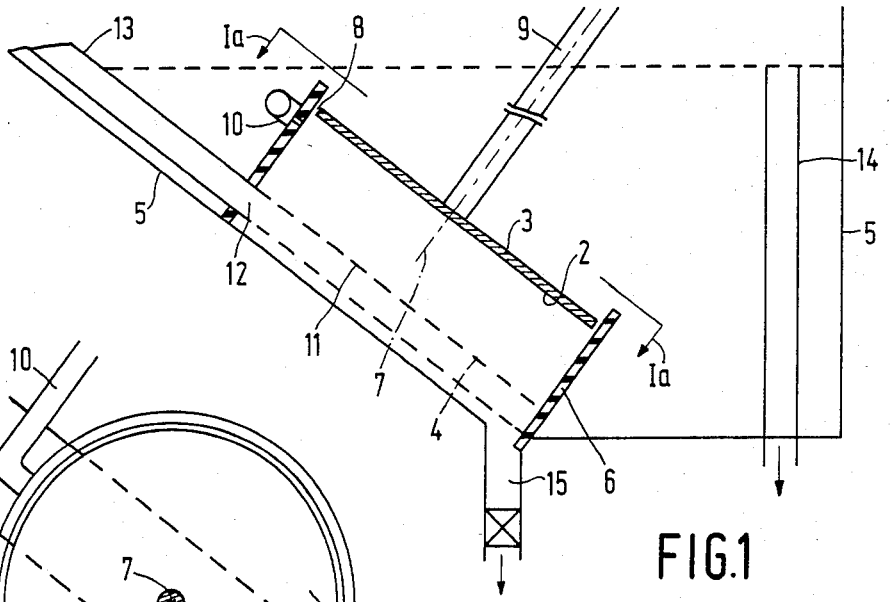
FIG. 1 is a diagrammatic sectional view of a device for carrying out the method according to the invention, and FIG. 1*a* a top view of the part, representing the cathode and the screening member.
Figure 1A:
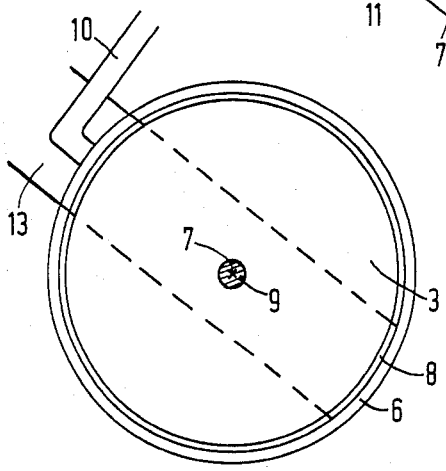

The Figures show a method of electrodepositing a homogeneously thick metal layer 1 on the surface 2 of a substantially flat substrate 3 in which an anode 4 and the substrate as cathode 3 are placed opposite to each other in an electrolyte bath 5 and a screening member 6 is present between the anode 4 and the cathode 3.

According to the invention a screening member 6 of electrically insulating material is used which has the shape of a cylinder whose axis 7 is perpendicular to the cathode 3 and which is furthermore provided so that a slot-shaped aperture 8 remains exposed between the cathode 3 and the screening member 6, the dimension of the slot-shaped aperture 8 being small as compared with the aperture of the screening member 6.

Figure 2:
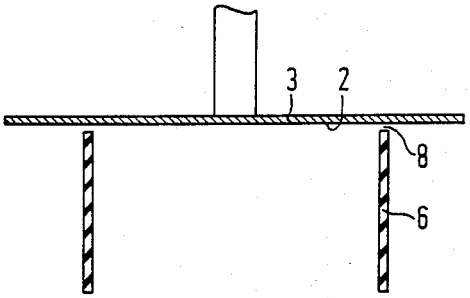
FIG. 2 is a diagrammatic sectional view of a part of a device for carrying out a modified embodiment of the method according to the invention.
Figure 3:
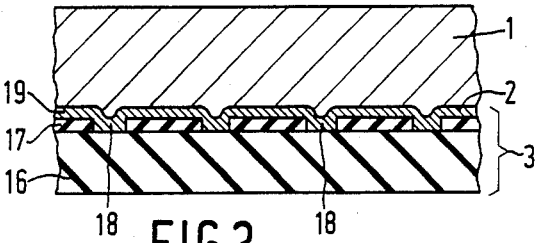
FIG. 3 is a diagrammatic sectional view of a part of a cathode comprising a metal layer by means of the method according to the invention.

In this method a screening member 6 may be used which encloses the cathode 3 while leaving the slot-shaped aperture 8 exposed (see FIG. 1) or a screening member whose area of the aperture is smaller than the area 2 of the cathode 3 (see FIG. 2) and in which the cathode 3 screens the aperture of the screening member 6 while leaving the slot-shaped aperture 8 exposed.

A screening member 6 is often used the aperture of which is circular and a cathode 3 is used in the form of a circular disk which is rotated in the electrolyte bath about the central axis 9 perpendicular to the disk surface 2 on which the deposition occurs.

The screening member 6 is furthermore chosen to be so as to be perpendicular to the anode 4 and to enclose the anode entirely. The cylinder surface of the screening member 6 has an inlet 10 for the flow of the electrolyte to the slot-shaped aperture between the cathode 3 and the screening member 6 as an outlet.

An anode 4 is preferably used which comprises a hollow space in which metal is present which is to be deposited on the cathode 3. Said space comprises, for example, a gauze-like aperture 11 through which the electrolyte introduced through the inlet 10 into the screening member 6 is dissipated partly. The space furthermore comprises an aperture at the region of an aperture 12 in the screening member 6 where this encloses the anode 4, through which last-mentioned apertures and, for example, a filling pipe 13 the metal in the space is replenished.

The aperture between the screening member 6 and the cathode 3 is, for example, 5 mm. The surface 2 of the cathode 3 may be provided with a profile having a thickness which is a few orders of magnitude smaller than the thickness of the metal layer 1 to be electrodeposited. The metal layer 1 may also be separated from the cathode 3.

When the metal layer 1 is used in the manufacture of video or audio information carriers, there may be proceeded as follows according to the invention for the manufacture of the metal layer 1.

The glass plate 16 having a diameter of 35.6 cm and a thickness of 6 mm is provided with a positive photolacquer layer 17 (for example Shipley AZ 1350) having a thickness of 0.12 μm. A pattern of apertures 18 desired for the information carrier is provided photomechanically in the photolacquer layer 17 in a usual manner.

The apertures have a length of 0.5–2 μm and a width of 0.4 μm and form concentric tracks on the disk, the pitch between the tracks being 1.6–2.0 μm. A 0.08–0.1 μm thick silver layer 17 is vapour-deposited on the photolacquer 17 in any usual manner. The assembly of glass plate 16, photolacquer layer 17 and silver layer 19 constitutes the cathode 3.

The cathode 3 is placed in a bath 5 containing an electrolyte which consists of a solution in water of 445 g/l of nickel sulphamate, 35 g/l of boric acid, 15 g/l of nickel chloride hydrate ($NiCl_2.6H_2O$) has a pH=4.0 and during deposition is kept at 50° C. Optionally, 5–125 mg/l of 2-butyn-1,4-diol are added to the bath, which has a favourable influence on the reduction of the roughness of the metal layer to be formed. The electrolyte circulates via the inlet 10 the slot-shaped aperture 8 and the gauze-like aperture 11. The electrolytes emanating from outlets 14 and 15 are combined and optionally supplied to the inlet 10 via a usual cleaning system.

During the deposition the cathode is rotated at a speed of 60 rpm.

The anode 4 consists, for example, of a usual basket of titanium filled with nickel grains.

The screening member is a 10 cm high cylinder of polythene having an inside diameter of 36 cm. The distance to the cathode then is 2 mm.

The deposition of the layer 1 is started, for example, at a low current density which is gradually increased, for example, 2 min. 0.5 A, i.e. with an area of 10 $dm^2$ 0.05 $A/dm^2$, then 5 min. at 1 A
5 min. at 10 A
5 min. at 20 A and the remainder at 80 A until a layer thickness of 300 $\mu m$ has been reached. A tolerance of $\pm 2$ $\mu m$ is found. The metal layer together with the silver layer 19 can be lifted from their substrate in the usual manner, the last grown side being substantially flat and the first grown side showing the negative of the profile of the photolacquer layer 17.

The metal layer may be used with its profiled side in a matrix for injection moulding carriers for video or audio disks.

The metal layer may also be used in other shaping methods of the said information carriers, for example, by providing in the usual manner a liquid lacquer layer and a substrate on the profiled side of the metal layer and then curing the lacquer layer by means of ultraviolet radation as a result of which, after separation of the metal layer from the assembly lacquer layer-substrate, a lacquer layer is obtained having the negative profile of the metal layer.

Carriers which are provided in any usual manner with a metal layer for the said disks can be obtained both by means of injection moulding and curing of lacquer layers.

The metal layer obtained by means of the method according to the invention can also be used for the manufacture of a family of metal layers, the metal layer being used as cathode.

In this method the metal layer is provided for example, with its flat side on an aluminum supporting plate and with its profiled side facing the screening member. Before nickel is deposited the nickel surface of the cathode is passivated by a treatment with a solution of potassium bichromate for 1 min. at 20° C. so as to obtain a very thin separation layer with the fresh nickel layer to be formed, a separation layer which nevertheless does not prevent the current passage to the cathode. It has been found that with a current density of 14 $A/dm^2$ in $\approx 1.8$. hours a second nickel layer of 300 $\mu m$ can be obtained in otherwise the same manner as the first nickel layer. Due to the separation layer the two nickel layers can easily be separated from each other.

It will be obvious that the invention is not restricted to the examples described but that many variations are possible to those skilled in the art.

Instead of nickel layers, for example, copper layers may be deposited, for example, by means of copper sulphate-sulphuric acid baths.

The cathode of the screening member need not have the ultimate shape of the metal layer to be used. Partial layers of the desired dimensions can be manufactured from the deposited metal layers by means of the usual processing methods.

The method according to the invention may also be used, for example, for the manufacture of matrices for pressing grammophone records.

The profile of the cathode and the thickness of the metal layer may also be chosen to be so that details of the profile occur in the ultimate surface of the metal layer. Even interrupted metal layers of homogeneous thickness can be deposited by means of the method according to the invention.

The screening member may consist entirely of insulating material but may also comprise an electrically conductive core which is covered with a layer of insulating material.

For simplifying the operation of the device according to the invention, the screening member may be built up, for example, from two parts which in the operating condition adjoin each other closely and/or overlap each other and together constitute the cylinder.

What is claimed is:

1. A method for the electrodeposition of a homogeneously thick metal layer on the surface of a substantially flat substrate in which an anode and the substrate as cathode are placed opposite to each other in an electrolyte bath and an apertured screening member is present between the planes of the anode and the cathode, characterized in that a screening member is formed of an electrically insulating material which screening member has the shape of a cylinder whose axis is perpendicular to the cathode and is furthermore positioned so that a slot-shaped aperture remains exposed between the cathode and the screening member, the dimension of the slot-shaped aperture being small as compared with the size of the aperture of the screening member.

2. A method as claimed in claim 1, characterized in that a screening member is used which surrounds the cathode while leaving the slot-shaped aperture exposed.

3. A method as claimed in claim 1, characterized in that a screening member is used the area of the aperture of which is smaller than the area of the cathode and the cathode screens the aperture of the screening member while leaving the slot-shaped aperture exposed.

4. A method as claimed in claim 1, characterized in that a cathode is used which has the shape of a circular disk which is rotated in the electrolyte bath about the central axis perpendicular to the disk surface on which the deposition occurs.

5. A method as claimed in claim 1, characterized in that a screening member is chosen which is perpendicular to the anode and surrounds the anode entirely.

6. A method as claimed in claim 1, characterized in that a screening member is used whose cylinder surface comprises an inlet for the flow of the electrolyte to the slot-shaped aperture between the cathode and the screening member as an outlet.

7. A method as claimed in claim 5, characterized in that an anode is used which comprises a hollow space in which a metal is present which is to be deposited on the cathode, the said space comprising an aperture through which the electrolyte introduced into the screening member through the inlet is dissipated partly and which space furthermore comprises an aperture at the region of an aperture in the screening member through which the metal in the space is replenished.

8. A method as claimed in claim 1, characterized in that the surface of the cathode is provided with a profile having a thickness which is a few orders of magnitude smaller than the thickness of the metal layer to be electrodeposited and that the metal layer is separated from the cathode.

9. A metal layer manufactured by means of the method as claimed in claim 8.

10. The use of the metal layer as claimed in claim 9 in manufacturing information carriers.

11. A device for the electrodeposition of a homogeneously thick metal layer on the surface of a substantially flat substrate in which an anode and the substrate as a cathode are placed opposite to each other in an electrolyte space and a screening apertured member is present between the planes of the anode and the cathode, characterized in that the screening member at least at its surface consists of electrically insulating material and has the shape of a cylinder in which the axis is perpendicular to the cathode and is positioned so that a slot-shaped aperture remains exposed between the cathode and the screening member, the dimension of the slot-shaped aperture being small as compared with the size of the aperture of the screening member.

12. A matrix for the manufacture of information carriers, characterized in that the matrix comprises a metal layer having a thickness tolerance which is less than 1%, said metal layer produced by the method of claim 1.

* * * * *